United States Patent [19]

Eskijian

[11] Patent Number: 4,516,767

[45] Date of Patent: May 14, 1985

[54] INFLATABLE PLATFORM FOR REPETITIVE BOUNCING

[76] Inventor: Luther Eskijian, 2223 Midlothian Dr., Altadena, Calif. 91001

[21] Appl. No.: 406,269

[22] Filed: Aug. 9, 1982

[51] Int. Cl.[3] ..... A47C 27/08; A63B 5/00

[52] U.S. Cl. ..... 272/65; 5/420; 5/449; 272/70

[58] Field of Search ..... 272/65, 70, 130, 69, 272/74, 109, 135–140, 144, 146, DIG. 9, 130, 93; 5/441, 448, 452, 456, 457, 417, 420, 449, 450; 182/137–140; 152/350, 354 R, DIG. 14

[56] References Cited

U.S. PATENT DOCUMENTS

| | | | |
|---|---|---|---|
| 1,456,168 | 5/1923 | Witmer et al. | 272/65 |
| 1,738,411 | 12/1929 | Welch | 5/457 |
| 3,129,740 | 4/1964 | Nourse et al. | 272/65 |
| 3,130,816 | 4/1964 | Wright | 272/146 |
| 3,206,776 | 9/1965 | Moore | 5/457 |
| 3,734,496 | 5/1973 | Rubin | 272/65 |
| 3,983,587 | 10/1976 | Gorran | 5/441 |
| 4,042,742 | 8/1977 | Bergomi | 152/354 R |
| 4,065,124 | 12/1977 | Egan | 272/65 |
| 4,068,739 | 1/1978 | Gordon et al. | 182/139 |
| 4,121,310 | 10/1978 | Gorran | 5/452 |
| 4,159,826 | 7/1979 | Hancock | 272/65 |
| 4,382,305 | 5/1983 | Hall | 5/441 |

FOREIGN PATENT DOCUMENTS

| | | | |
|---|---|---|---|
| 1109606 | 1/1956 | France | 5/441 |

OTHER PUBLICATIONS

Applicant has filed in the Patent Office on Aug. 6, 1981, an Application, Ser. No. 290,600 which Relates to Apparatus to Provide Beneficial Oscillation to the Body.

*Primary Examiner*—Richard J. Apley
*Assistant Examiner*—S. R. Crow
*Attorney, Agent, or Firm*—William W. Haefliger

[57] ABSTRACT

An inflated platform, for bouncing, includes a reinforced upstanding and flexible outer side wall to resist outward expansion during bouncing, and a central upper wall at a lower level than an annular flexible top wall that merges with the central wall and side wall, the central wall overlying and spaced from a bottom flexible wall. A reinforcing layer is carried by the central wall and is centered by air pressure below the annular top wall and surrounding that layer, during bouncing; the reinforced layer and the reinforced side wall cooperating to aid platform stability during bouncing.

2 Claims, 3 Drawing Figures

INFLATABLE PLATFORM FOR REPETITIVE BOUNCING

BACKGROUND OF THE INVENTION

This invention relates generally to activating or assisting natural healing processes in a living body, and more particularly concerns the use of body oscillation to enhance the functioning of the lymphatic system.

There are two circulatory systems in the human body, the first being for the circulation of the blood, with the heart doing the pumping to achieve circulation. The other is the lymphatic system, which is just as complex, if not more so, as the blood system; however the lymphatic fluid moves only by the muscular action of the body, or by induced rapid oscillation of the body through outside forces.

Unlike the blood system which is activated by the continuous pumping of the heart, the lymphatic system must have body movement which contracts and relaxes the muscles which in turn compresses and releases the tissue spaces around the cells, to obtain the flow of the plasma protein fluids. Therefore, if a person is ill, or in a coma, or is paralyzed, and not able to move, then that person's body deteriorates at a faster rate than normal, because the lymph system is not sufficiently active to carry off the toxins of the body.

In order to understand how to obtain and maintain good health, one must know the functions of the lymphatic system, and consider the following:

(a) The blood is the "corruptible" part of man, being 91% water; and it depends upon the lymphatic system for the introduction of oxygen into the blood stream and the purification necessary for good health, (b) plasma proteins must be continuously moved by the lymphatic system; otherwise, they will block the circulation system, which could cause death, (c) when plasma proteins get "trapped" in the spaces around the cells, commonly known as water retention of the body, it means that the potassium-sodium balance of the body is thrown off and serious consequences may result, (d) when the system is working properly areas around the cells are known as being in a "dry" state, and the cells are receiving sufficient oxygen and nutrients necessary for good health, (e) with the movement of the lymphatic fluids, one receives the same results as one receives in deep breathing during exercise, with fresh oxygen being induced into the blood stream, (f) proper circulation of the plasma proteins help prevent degenerative diseases, (g) trapped proteins attract the sodium ions, thereby upsetting the sodium-potassium balance which interferes with the electrical activity of the cells, and restricts the intake of the nutrients, as well as the removal of wastes.

(h) the plasma proteins, when properly circulating, carry off the toxins of the body to the liver, where they are cleansed, and the blood returned to the body circulatory system, (i) in some cases, pain can be relieved by the moving out of the blood protein plasma by the activation of the lymphatic system, which introduces oxygen into the blood system in the painful areas.

See also applicant's pending application Ser. No. 290,600, filed Aug. 6, 1981.

SUMMARY OF THE INVENTION

It is a basic object of the invention to provide beneficial oscillation to the body of a living person who is substantially capable of self-directed exercise, or in active condition.

Apparatus incorporating the invention basically comprises: An inflatable platform having an upper surface on which to stand, during bouncing. Typically, the platform consists of elastomeric material defining a hollow interior to receive pressurized gas; and the platform is deflectible, frameless, and may be reinforced as will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
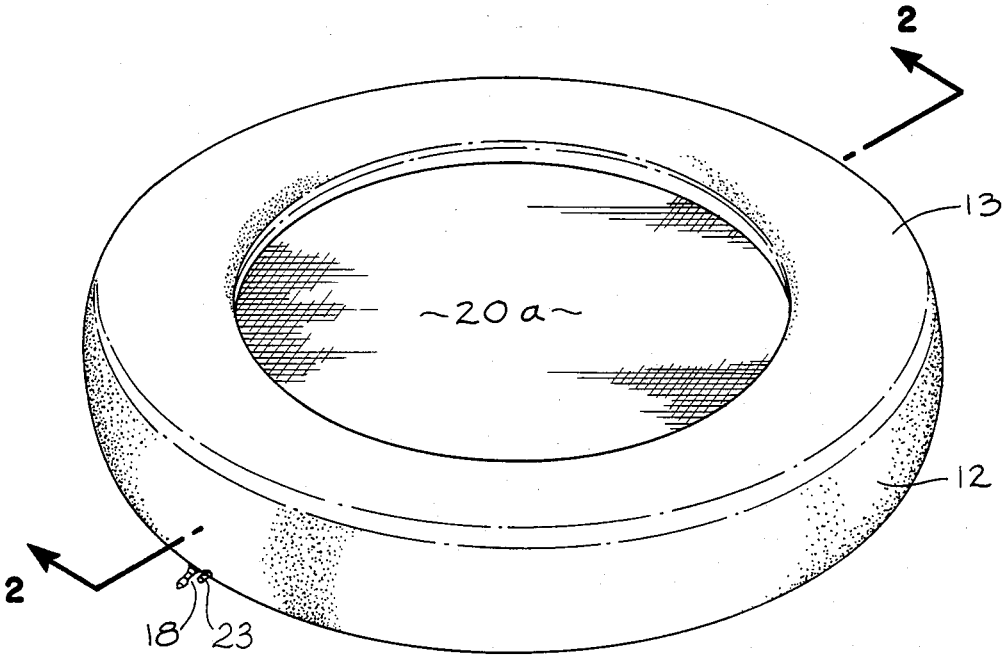
FIG. 1 is a perspective view of apparatus embodying the invention.
Figure 2:
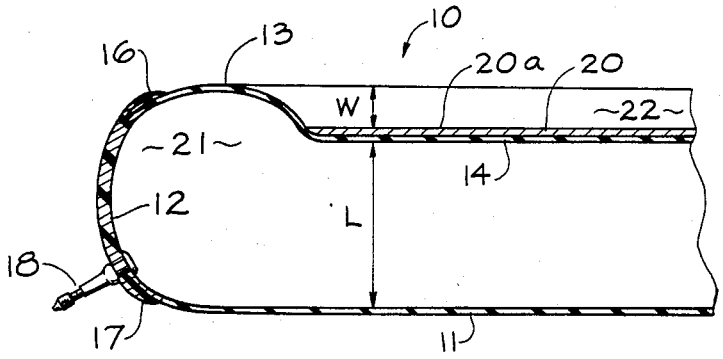
FIG. 2 is an enlarged side elevation of the FIG. 1 apparatus, taken in section as lines 2—2 of FIG. 1.
Figure 3:
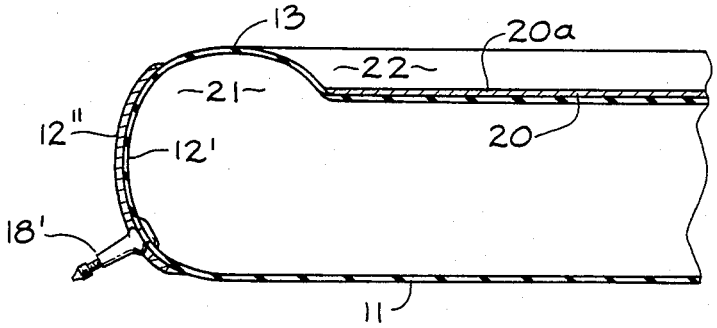
FIG. 3 is a view like FIG. 2, showing a modification.

In FIGS. 1 and 2, the inflatable platform 10 is to be used in repetitive bouncing, to improve blood and lymphatic fluid circulation. The platform is generally round, (or may be square or rectangular) and has a bottom wall 11, annular side wall 12, annular top wall 13, and upper central wall 14, lower than wall 13, the walls being contiguous and typically unitary, as shown. The walls 11, 13 and 14 typically consist of elastomeric material such as natural or synthetic rubber. In FIG. 2, wall 12 consists of elastomeric material containing molded-in reinforcement such as glass fibers. Note that the upper and lower peripheries of wall 12 are molded to walls 13 and 11 at locations 16 and 17. In FIG. 3, the corresponding side wall comprises an inner elastomeric layer 12' integral with walls 11 and 13, and an outer layer 12'' of glass fiber and resin sheeting, attached to layer 12' at their interfaces, as by suitable bonding. Layer 12'' provides reinforcement, during bouncing. The purpose of the reinforcing 12'' is to allow the increased pressure generated during bouncing to be transmitted upwardly in area 13; to keep the unit from lateral movement during bouncing; and to contain the pressure within the form.

Note the fill valve stems 18 and 18' in FIGS. 2 and 3, attached to the side walls at a lower concealed level so as not to be struck by the person bouncing on the device.

Note also the provision of an upper surface **20*a* on which to stand during bouncing. Surface 20*a* may be provided by a layer or sheet 20 of molded glass fibers and synthetic resin, which is substantially less flexible than wall 14 on which is lays. Layer 30 and wall 14 are spaced downwardly at distance "w" from the level of annular wall 13, so that the platform layer 20 is centered by air pressure confined in annular region 21, below wall 13. Region 21 bulges upwardly about layer 20 and wall 14, and a recess 22 is formed immediately above layer 20. This contributes to stability of the platform, and bouncing layer 20, as does reinforcement at or in side wall 12. Note that wall 14 and layer 20 are at distance L above bottom wall 11, so that 14 and 20 do not contact wall 11** during bouncing.

Typical dimensions of the platform are about 36 inches in diameter and about 6 inches in overal height. The unit may have other dimensions and forms, and is foldable, when deflated. A safety valve may be employed, as at 23 in FIG. 1, to control any over-inflation of the unit.

The purpose of the device, is to aid the circulation of the lymphatic and cardiovascular systems of the body, keeping in mind that all exercise should be done under the control and supervision of the person's physician. The unit is placed on the floor and the user bounces only a few inches up and down upon it, producing the desired results. It is inflatable and deflatable, so that it could be taken on trips, and with a hand pump, be inflated and used.

Safety valve 23 may be incorporated in fill valve 18. Also, recess 22 may be developed by the user standing on the platform.

I claim:

1. Apparatus for use in repetitive bouncing to improve blood and lymphatic solution circulation, the apparatus comprising (a) an inflated platform, that consists of flexible elastomeric material defining a hollow interior in which pressurized gas is received, (b) the platform having a central upper wall and there being a reinforced layer on said upper wall on which to stand, during bouncing, the platform having an annular top wal at substantially higher level than said layer, and a bottom wall beneath said upper wall, (c) the platform having a side wall which integrally merges with said top and bottom walls, and which is reinforced to resist outward expansion during bouncing, the annular top wall merging with said central upper wall, (d) said side wall being everywhere openly and unobstructedly exposed to all of said hollow interior below said upper central wall and above said bottom wall, and also below said annular top wall, (e) there being a flat reinforcement layer on and covering said central upper wall, (f) the platform being deflectible and frameless, the platform defining an upwardly opening recess immediately above said upper layer, the depth of said hollow interior below said central wall being sufficient to prevent bottoming of said wall during bouncing, (g) the platform annular side wall having associated glass fiber reinforcement, the thickness of said side wall and reinforcement substantially exceeding the thickness of each said top and bottom walls, and a gas fill valve in said side wall near said bottom wall.

2. Apparatus usable in repetitive bouncing, said apparatus comprising (a) an inflated platform consisting of flexible elatomeric material defining a hollow interior in which gas is received for maintaining the platform inflated, (b) said material defining an annular upstanding outer side wall, a substantially flat and horizontal bottom wall merging with said outer side wall at an annular lower location, and an annular top wall merging with said side wall at an annular upper location, (c) there being reinforcement associated with and extending substantially throughout the extent of said side wall to resist radially outward expansion of said side wall, the side wall and said reinforcement having thickness substantially greater than the thickness of said bottom wall and said top wall, (d) said elastomeric material defining an upper central wall which extends generally horizontally and is spaced directly above said bottom wall, said annular top wall extending radially inwardly and downwardly to integrally merge with the periphery of said central wall whereby the central wall is everywhere at a substantially lower level than the major extent of said top wall, (e) and a reinforced everywhere horizontal layer of material carried by said central elastomeric wall and characterized by lesser flexibility than said central wall, said layer covering substantially the entirety of the central wall and extending to th peripheral region of said central wall, whereby said layer is centered by gas in said inflated platform surrounding the layer, (f) said side wall being everywhere openly and unobstructedly exposed to all of said hollow interior below said upper central wall and above said bottom wall and also below said annular top wall.

* * * * *